US009673015B2

(12) United States Patent
Jiang et al.

(10) Patent No.: US 9,673,015 B2
(45) Date of Patent: Jun. 6, 2017

(54) PARTIALLY GROUNDED DEPRESSED COLLECTOR

(71) Applicants: OMEGA-P, INC., New Haven, CT (US); YALE UNIVERSITY, New Haven, CT (US)

(72) Inventors: Yong Jiang, New Haven, CT (US); Vladimir Teryaev, Protvino (RU); Jay Hirshfield, Orange, CT (US)

(73) Assignees: OMEGA-P, INC., New Haven, CT (US); YALE UNIVERSITY, New Haven, CT (US)

( * ) Notice: Subject to any disclaimer, the term of this patent is extended or adjusted under 35 U.S.C. 154(b) by 69 days.

(21) Appl. No.: 14/846,151

(22) Filed: Sep. 4, 2015

(65) Prior Publication Data

US 2016/0071681 A1 Mar. 10, 2016

Related U.S. Application Data

(60) Provisional application No. 62/046,053, filed on Sep. 4, 2014.

(51) Int. Cl.
*H01J 23/027* (2006.01)
*H01J 25/10* (2006.01)

(52) U.S. Cl.
CPC ..... *H01J 23/027* (2013.01); *H01J 23/0275* (2013.01); *H01J 25/10* (2013.01)

(58) Field of Classification Search
CPC ..... H01J 25/10; H01J 25/02; H01J 23/0275; H01J 23/30; H01J 23/00; H03F 3/56
See application file for complete search history.

(56) References Cited

U.S. PATENT DOCUMENTS

| | | | | |
|---|---|---|---|---|
| 4,277,721 | A * | 7/1981 | Kosmahl | H01J 23/0275 315/3.6 |
| 6,870,318 | B2 * | 3/2005 | Cascone | H01J 1/135 315/5.35 |
| 7,385,354 | B2 | 6/2008 | Miyake | |
| 2001/0011924 | A1 * | 8/2001 | Symons | H01J 23/0275 330/45 |
| 2002/0149316 | A1 | 10/2002 | Mako | |
| 2013/0229109 | A1 * | 9/2013 | Teryaev | H01J 25/10 315/5.39 |

OTHER PUBLICATIONS

International Search Report of PCT/US2015/048578 dated Jan. 14, 2016.

* cited by examiner

*Primary Examiner* — Jany Richardson
(74) *Attorney, Agent, or Firm* — Arent Fox LLP

(57) ABSTRACT

A depressed beam collector and an RF source comprising a depressed beam collector. The RF source may include, e.g., a multi-beam klystron, a single beam klystron, or other RF sources having an electron gun. The beam collector collects spent electrons from the electron gun and comprises a grounded portion configured to collect a portion of electrons entering the collector and a biased portion configured to collect another portion of the electrons entering the collector and having a depressed energy.

20 Claims, 22 Drawing Sheets

FIG. 3A
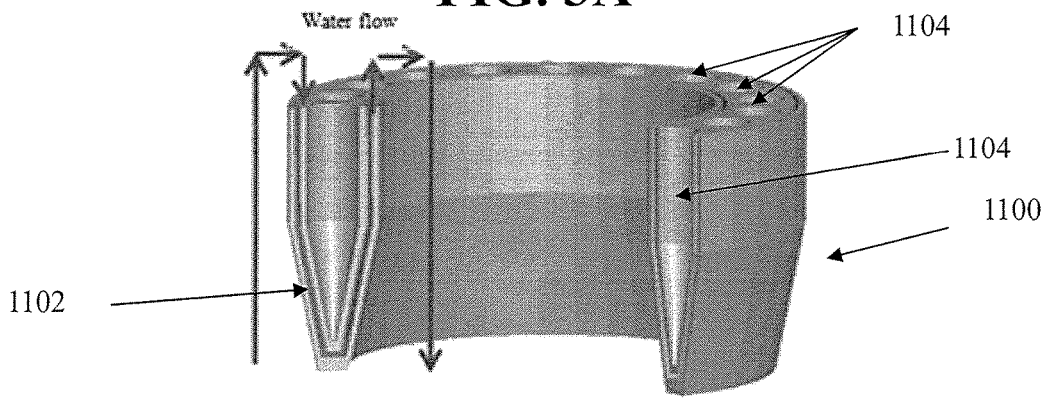
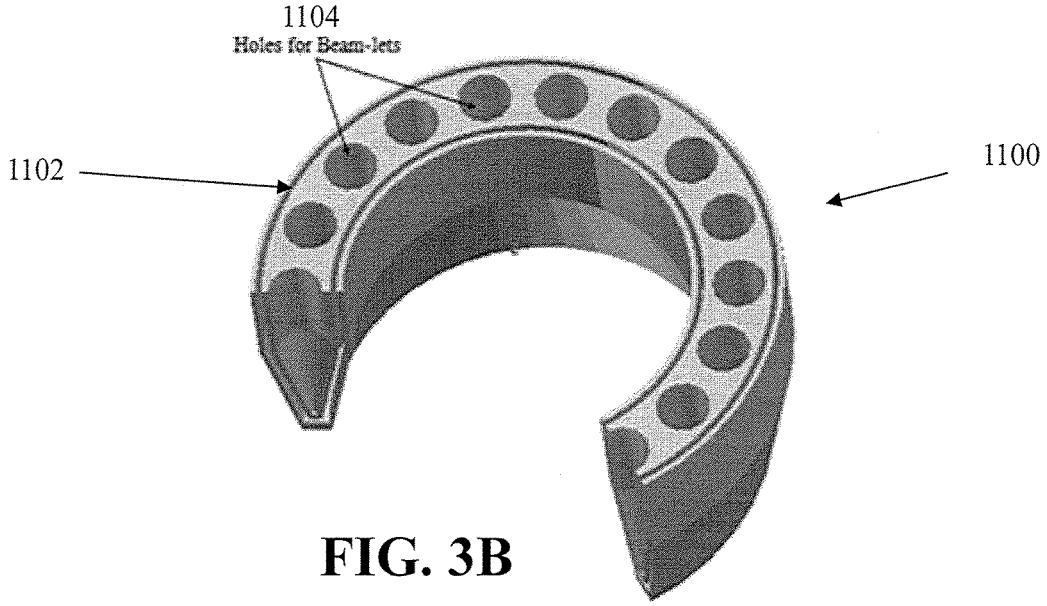
FIG. 3B
Collector with independent openings for each of the beamlets.
Collector openings have no RF coupling to each other.

Schematic of microwave tubes without DC

Schematic of microwave tubes with SDC

Schematic of microwave tubes with MSDC

**Overall MBK efficiency *vs* collector efficiency for four values of RF circuit efficiency , where the red bar indicates for a conventional SDC, and blue for the DC presented herein.**

Example PGDC, where an addititional magnetic lens system is added with a collector coil and iron pole piece Example MSDC Compared overall efficiency between conventional SDC, MSDC, and proposed PGDC

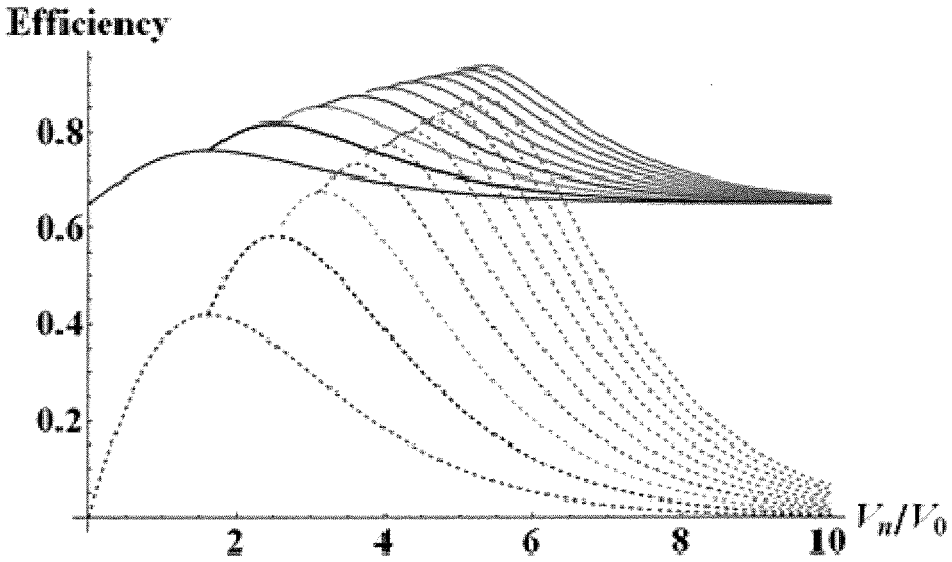

FIG. 13A

| Total Stages $n$ | Last Stage $V_n/V_0$ | Collector Efficiency $\eta_c$ | Tube Efficiency $\eta_t$ |
|---|---|---|---|
| 1 | 1.62 | 42% | 76.2% |
| 2 | 2.52 | 59% | 82.7% |
| 3 | 3.1 | 68% | 85.1% |
| 4 | 3.6 | 73% | 87.4% |
| 10 | 5.2 | 86% | 92.8% |

PGMSDC total tube efficiency (solid lines) and collector efficiency (dotted lines) versus the last stage voltage , with single stage (purple), two stages (blue), three stages (green), four stages (red), and higher stages (brown), where the RF circuit efficiency without depressed collector is set at 65% and the spent beam is taken to have a Gamma distribution .

FIG. 13B

MBK beam collector showing only a single channel

Layout of a PGDC incorporated into an MBK, showing only one channel.

Magnetic field distribution within a depressed collector

Static potential and magnetic field distributions along the beam-let axis

Unmodulated beam trajectory in a PGDC

PARTIALLY GROUNDED DEPRESSED COLLECTOR

CLAIM OF PRIORITY

The present application for patent claims priority to Provisional Application No. 62/046,053 entitled "MULTI-BEAM KLYSTRON WITH A DEPRESSED COLLECTOR" filed on Sep. 4, 2014, the entire contents of which are hereby expressly incorporated by reference herein.

BACKGROUND

Field

Aspects described herein relate generally to a Radio Frequency (RF) source having a beam collector.

Background

Aspects described herein relate generally to a RF source having a beam collector. This may include, e.g., low-voltage, multi-beam RF source/amplifier for accelerators, e.g. a low-voltage Multi-Beam Klystron (MBK) as well as single beam klystrons, widely used in accelerator systems.

RF sources can be used to power accelerators, such as ILC-type SRF accelerator structures among others.

High voltage power sources are expensive and complex. Thus, there is a need in the art for an RF amplifier that meets the necessary output parameters with reduced complexity and with lower power requirements.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Aspects presented herein provide an RF source with a depressed collector to allow recovery of a portion of the energy in a spent electron beam and thereby to increase the tube's efficiency and reduce cooling demands by reducing waste heat.

Aspects presented herein include a partially grounded depressed beam collector and an RF source comprising such a partially grounded depressed beam collector. The RF source may include, e.g., a multi-beam klystron, a single beam klystron, or other RF sources having an electron gun. The beam collector collects spent electrons from the electron gun and comprises a grounded portion configured to collect a portion of electrons entering the collector and a biased portion configured to collect another portion of the electrons entering the collector and having a depressed energy.

The biased portion may be coupled to a depressed power supply at a collector voltage.

An electron gun of the RF source may be configured to emit a plurality of electron beams, and the beam collector may comprise a plurality of channels, each channel corresponding to one of the plurality of electron beams.

The depressed beam collector may further include a magnetic lens configured to suppress reflection of a spent beam from the electron gun. The magnetic lens may be configured to create a magnetic field for guiding a spent beam to penetrate the grounded portion and then to disperse. The magnetic field may be configured to disperse the spent beam near and beyond a high voltage gap. The depressed beam collector may further include a high voltage gap and an iron pole piece at least partially surrounding the high voltage gap.

The depressed beam collector may comprise space charge forces configured to disperse a trajectory of a decelerated spent beam.

The beam collector may be a single-stage depressed beam collector or a multi-stage depressed beam collector.

The depressed beam collector may comprise cooling channels in the grounded portion and the biased portion.

The depressed beam collector may be made of a material having a low secondary emission coefficient or may be coated of a material having a low secondary emission coefficient.

Additional advantages and novel features of these aspects will be set forth in part in the description that follows, and in part will become more apparent to those skilled in the art upon examination of the following or upon learning by practice of the invention.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which:

FIGS. 3A and 3B illustrate views of an example beam collector.

FIG. 13A is a graph of total tube efficiency and collector efficiency for a multi-stage depressed beam collector.

FIG. 13B is a table showing details of the graph in FIG. 13A.

DETAILED DESCRIPTION

Various aspects are now described with reference to the drawings. In the following description, for purposes of explanation, numerous specific details are set forth in order to provide a thorough understanding of one or more aspects. It may be evident, however, that such aspect(s) may be practiced without these specific details. These and other features and advantages are described in, or are apparent from, the following detailed description of various example illustrations.

One example of an RF source is an MBK, e.g., as detailed in U.S. Pat. No. 8,994,297, titled "Low-Voltage, Multi-Beam Klystron" and issued on Mar. 31, 2015, the entire contents of which are incorporated herein by reference.

Figure 1:
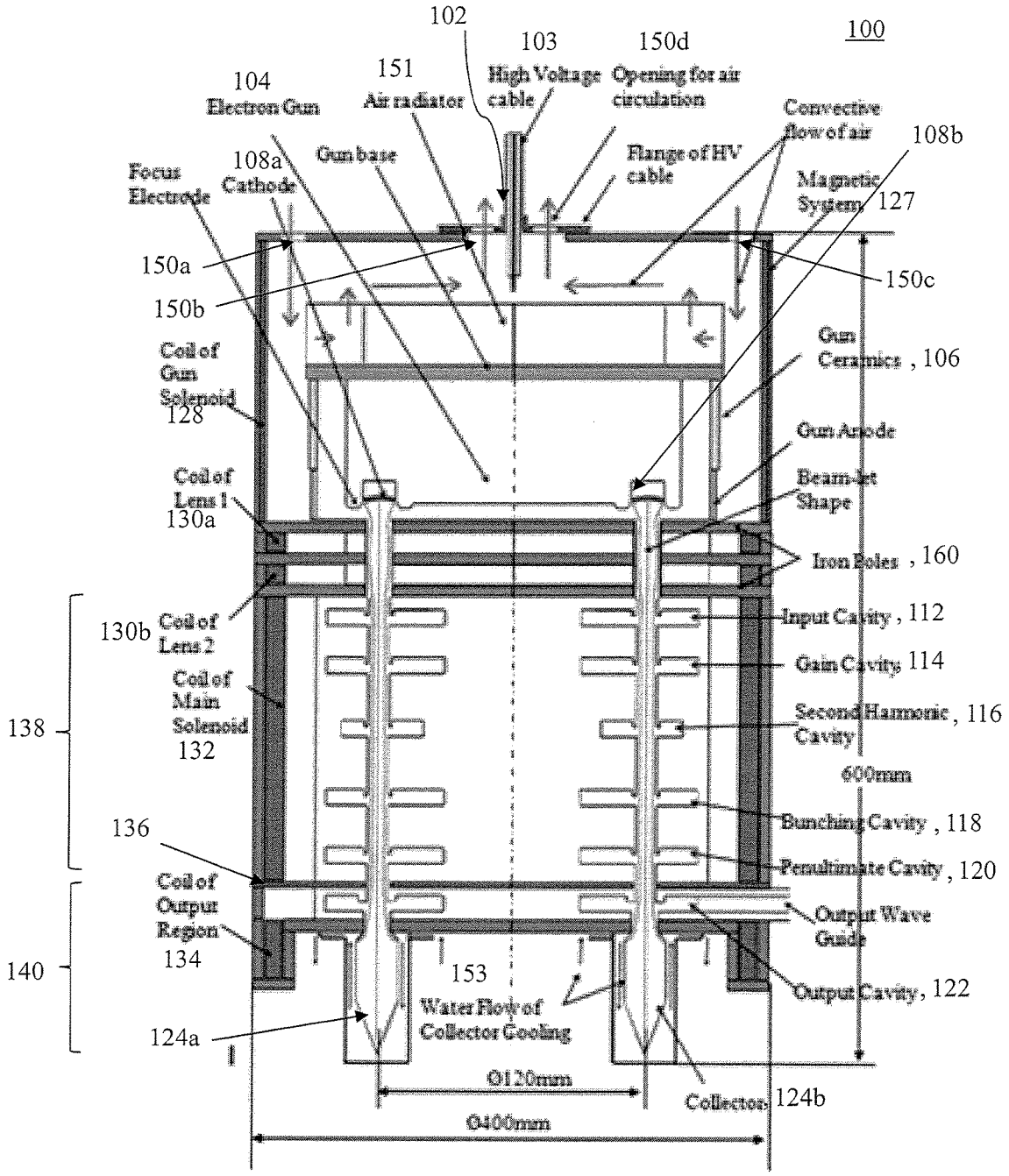
FIG. 1 illustrates an example multi-beam RF source.
Figure 2:
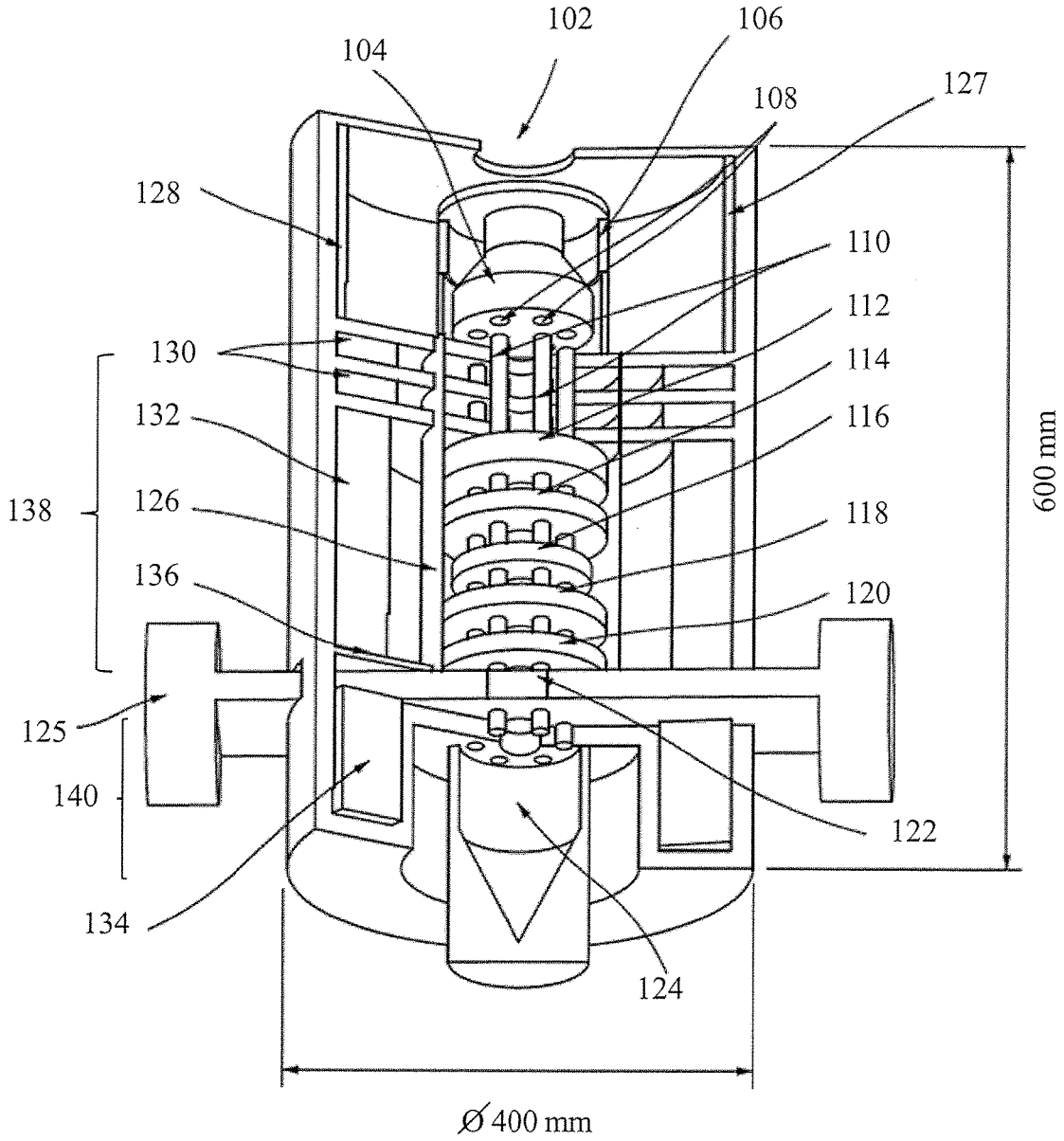
FIG. 2 illustrates a cross section of an example multi-beam RF source.

FIG. 1 illustrates aspects of an example cross section of an example of such an MBK 100. In FIG. 1, the MBK 100 includes an opening 102 for a high voltage input, e.g., a high voltage cable 103. An electron gun 104 includes cathode ceramics 106 configured to generate a plurality of beamlets at each of beamlet cathodes 108*a*, 108*b*. Although the cross section only enables a view of two beamlet cathodes 108*a*, 108*b*, cathode 106 may be configured to include between 10-20 beamlet cathodes 108. Beamlet drift tubes 110, e.g., as illustrated in FIG. 2, may be used to connect between the beamlet cathodes and input cavity 112. The input cavity is provided in common to the beamlets of the electron gun 104. A series of gain cavities, e.g. a gain cavity 114, a second harmonic cavity 116, a bunching cavity 118, and a penultimate cavity 120 are provided in line after the input cavity 112. Each of the coaxial cavities includes a plurality of openings, one opening for passing each of the beamlets. An output cavity 122 is provided common to each of the beamlets at the end of the group of gain cavities 114-120 opposite the input cavities 112. The output cavity may further include an output RF window 125, e.g., as illustrated in FIG. 2.

The drive and the output cavity may be configured so as to insure acceptable surface electric fields, good output efficiency, as well as absence of parasitic self-excitation in all possible regimes of tube operation. The output cavity may be coupled into two WR-650 output waveguides, e.g., WR-650 output waveguides. A coupling arrangement may be provided from the output cavity into two integral output waveguides and windows.

The geometries of the RF cavities and the magnetic field profile may be configured in order to eliminate self-excitation of parasitic modes.

The electron gun 104 and sets of cavities 112-122 may be surrounded by a klystron body, and a magnetic system 127. The magnetic system may include, e.g., a gun solenoid 128, a pair of lens coils 130*a*, 130*b*, a solenoid coil 132, and a coil 134 surrounding the output section. An iron plate 136 divides the cavity section 138 from the output section 140.

The magnetic system should be configured to achieve an optimal field profile that provides maximum tube efficiency. The magnetic system should also provide optimal beam matching with the electron gun and optimal beam dispersion of the beam in the beam collector. For example, the magnetic circuit may be configured to compensate for asymmetry experienced by the plurality of beamlets. The magnetic circuit may include a pair of lenses 130*a*, 130*b*, e.g., a two coil matching lens system that allows a variable beam diameter and Brillouin parameter. The magnetic circuit may include a gun solenoid 128 having a uniform magnetic field in a region of the electron gun. The magnetic circuit may include compensating coils 134 provided in an output section, with a uniform magnetic field.

The magnetic system may be divided by iron pole pieces into regions of independent control. These are regions of the gun, the matching optical system comprises a pair of lenses, the solenoid, and the output coil. The system of coils provides compensation of transverse fields on the axis of each beam-let to a level of ±0.5% of the longitudinal field. Non-compensated values are the angular components of magnetic field produced by beam currents. The cross-sectional area of the magnetic system should be configured to provide a large enough space to be occupied by a total beam current. The transverse fields produced by this current should not exceed the abovementioned level. The proposed magnetic system provides the necessary magnitude of a magnetic field in the solenoid, and insignificant values of tangential magnetic fields. Deviations of a beam-let from an axis should not exceed approximately 0.5 mm.

Other features may include a pair of matching lenses provide focusing of beam-lets over a wide range of parameters. Independently adjustable magnetic field in the output section may allow one to optimize efficiency of klystron and to minimize current interception of beam on walls. Sources of tangential magnetic fields may be considered and minimized.

The overall height of the illustrated MBK is approximately 60 cm with an approximately 40 cm diameter. The RF source in FIG. 1 generates a peak power output of up to approximately 660 kW in a pulse length in the approximate range of 5 to 30 ms, and with a pulse repetition rate of up to 10 Hz, e.g., 2-10 Hz.

In order to generate the desired pulse width, the RF source may be driven by a switched power supply or modulator.

The MBK includes a beam collector having beam collector channels 124*a*, 124*b*. Beam collector channels 124*a*, 124*b* are provided in a collector adjacent the output cavity 122 at the end of the klystron opposite the electron gun 104. Although the cross section only enables a view of two beam collector channels 124*a*, 124*b*, a beam collector is provided for each of the 10 to 20 beamlets. A technological hole may lead to the beam collector. The technological hole provides access for cooling, connections, and other maintenance access but does not affect the operation of the MBK.

FIG. 1 also illustrates example cooling aspects that may be provided in the MBK. For example, openings 150*a-d* may be provided in the side of the MBK housing the electron gun 104. In FIG. 1, arrows illustrate the convective air flow through these openings. An air radiator 151 may be provided inside the MBK. The air radiator 151 may be configured to pass a flow of air through the RF source adjacent to the electron gun 104, as illustrated in FIG. 1.

Water cooling aspects may be included, e.g., at the output portion of the MBK. FIG. 1 illustrates with arrows a path 153 for flowing cooling water through a portion of the collector adjacent to the collector channels 124*a*, 124*b*, etc.

Example parameters for the low-voltage, L-band MBK in FIG. 1 are listed in Table 1.

| Example Parameters for an MBK | |
|---|---|
| operating frequency | 1300 MHz |
| beam voltage | 60 kV |
| number of beam-lets | 6 |
| beam-let current | 12 A |
| beam-let microperveance | 0.816 |
| total beam current | 72 A |
| total micro perveance | 4.9 |
| simulation efficiency | 65% |
| output power | 2.8 MW |
| average output power | 40 kW |
| pulse duration | 1.6 ms |
| saturated gain | 50 dB |
| solenoid B-field | 1.0 kG |
| cathode loading | 2.1 A/cm$^2$ |

FIG. 2 illustrates a partially cut-away view of an example MBK that illustrates a common cathode, input and gain cavities 112-120, an output cavity 122, and a beam collector 124. As noted above, between 10-20 beamlet cathodes 108 may be provided in cathode 106.

The electron cathodes 108 immersed in the guide magnetic field each inject a focused pencil beam into the chain of gain cavities 112-120 forming the RF system. The distance between anodes and cathodes and the distance between beamlets can be optimized to reduce azimuthal drifts caused by the space charge electric field. The magnetic system 127 may be configured so that the guide magnetic field has no global radial component, thus eliminating azimuthal magnetic drifts. A beam voltage in the approximate range between 20 to 40 kV and individual cathode currents of approximately 2.56 A may be applied in order to correspond to a beamlet perveance below about $0.8\times10^{-6}$ A-V$^{-3/2}$. Each gun forms a beamlet approximately 6 mm in diameter that propagates in an approximately 10-14 mm beam tunnel. The beamlet optics in each gun may be configured independent of one another.

The external magnetic field provides beam focusing in the electron gun 104 and in the RF system. It may include three pole pieces 160 provided in the gun region that form a focusing magnetic field suitable to guide the beam with minimal scalloping.

In FIG. 2, the MBK includes one common collector having the separate channels (openings), e.g., 124*a*, 124*b*, etc., for each beamlet. Two partial cut-away views of an example collector layout are illustrated in FIGS. 3A and 3B. The collector 1100 includes a plurality of collector channels or openings 1104 corresponding to each of the beamlets in the cathode. The collector may be configured to include between 10-20 collector channels corresponding an electron gun having eighteen beamlet cathodes. The collector channels have no RF coupling to each other. Aspects may further include a beam collector capable of operating with a beam having a peak power of up to 1 MW and an average power of up to 60 kW.

FIGS. 3A and 3B also illustrate a cooling feature that may be included in the collector. For example, collector 1100 may include a passage 1102 that runs adjacent to the collector channel 1104. The passage may be configured to receive a flow of water that enters and exits the passage in the collector 1100 in order to cool the collector.

Another example of an RF source is a four cathode MBK, as detailed in U.S. Pat. No. 8,847,489 titled "Low-Voltage, Multi-Beam Klystron" and issued on Sep. 30, 2014, the entire contents of which are incorporated herein by reference.

Figure 4:
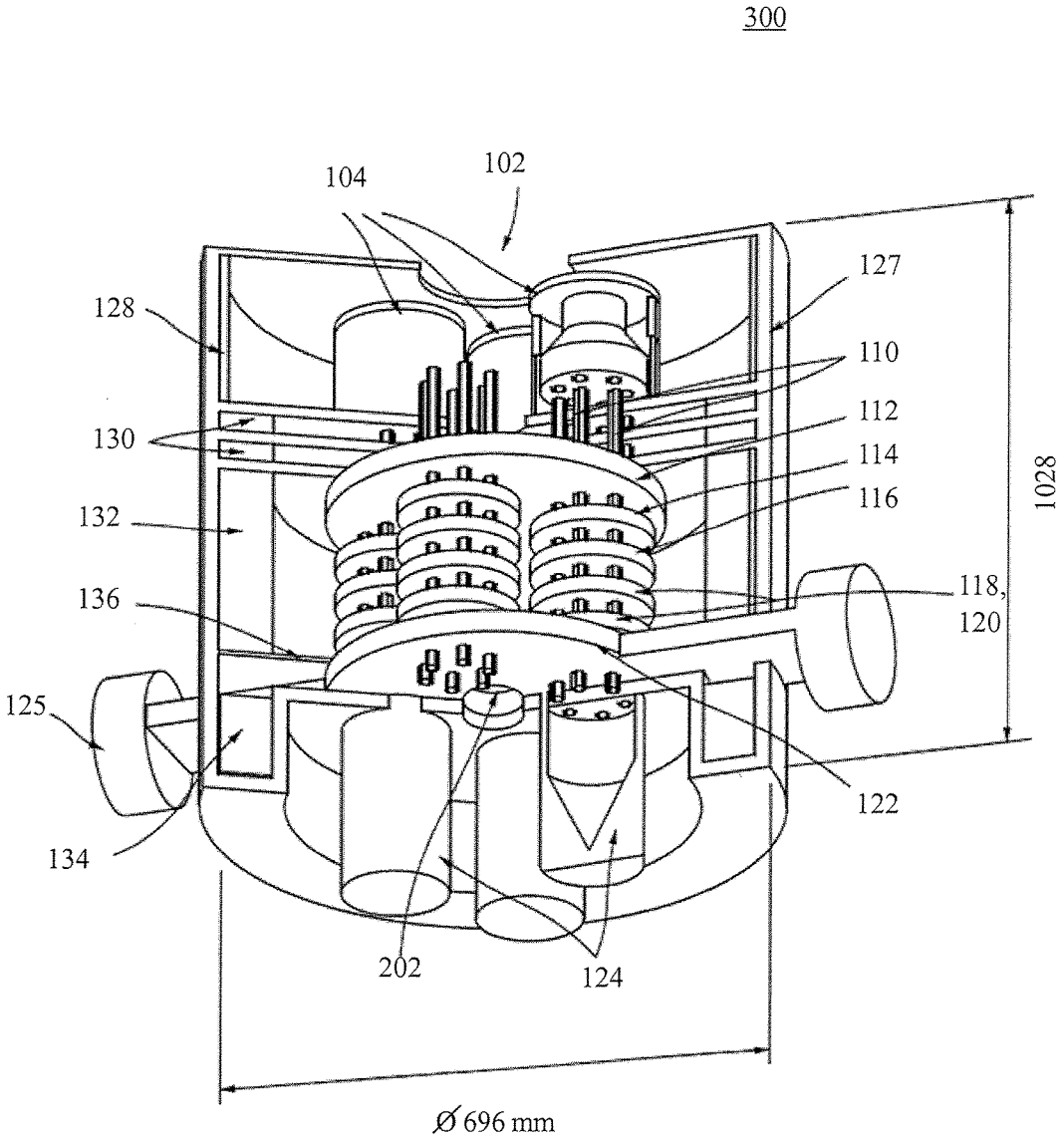
FIG. 4 illustrates an example multi-beam RF source.

FIG. 4 illustrates a cut-away view of a four cathode, 10 MW Klystron 300. Each quadrant of the 10 MW Klystron may be constructed and used independently. Similar elements are given the same reference number as in FIG. 2, and thus, will not be described in detail. The four cathode klystron 300 includes four cathodes 104. As with the single cathode configuration a common input cavity 122 and output cavity 122 are provided. However, a separate set of gain cavities, e.g. a gain cavity 114, second harmonic gain cavity 116, and first and second penultimate gain cavities 118 and 120, are provided separately for each of the cathodes in the cluster. An individual beam collector 124 is provided separately for each of the sets of beamlets from a single cathode in the cluster. A technological hole is provided 202 between the clusters of beamlets. The dimensions in FIG. 4 are shown in mm.

The four cathode power source includes four electron guns provided in a symmetrical configuration surrounding the opening for high voltage input. The input cavity and output cavity are common to each of the beamlets from each of the cathodes. The magnetic system is common to each of the beamlets from each of the cathodes. Each level of gain cavities includes a separate cavity for each of the cathodes. Thus, in this implementation, each level of gain cavity includes four sets of cavities, corresponding to each of the four cathodes. Similarly, four electrically independent beam collectors are provided in the output section.

Beam-lets are incorporated into 4 groups of 6 beam-lets for each group (cluster). Input and output cavities are the common for all beam-lets. Intermediate cavities can be common for 6 beam-lets of every cluster.

Each quadrant of the 10 MW Klystron in FIG. 4 can be considered independently. By assembling a 2.5 MW cluster diode gun having six cathodes that produces 60 kV, 12.5 A electron beam-lets, enables an optimal design to be selected for the combined 10 MW RF system of the MBK. The 10 MW system may include an axial guide magnetic field of about 1 kG in order to provide good beam focusing and a lack of current interception that is essential for operating at high average power.

The drive and output cavity should be constructed so as to insure acceptable surface electric fields, good output efficiency, as well as the absence of parasitic self-excitation in all possible regimes of tube operation. The output cavity may be coupled into two WR-650 output waveguides.

Cavities having separate drift tubes of similar shape may be used. These have not shown any problems connected with multipactor and beam instability. A configuration with separate drift tubes may be also provide a favorable spectrum of mode frequencies near to frequency of the second harmonic, 2.6 GHz. An output cavity having a small transient time angle provides higher impedance on this frequency and the amplitude of a field generated on this frequency can be dangerously high if the frequency of one of higher mode is close to the tube operating frequency harmonic 2.6 GHz.

It is noted that cavities having ring ledges may also be used, but such a configuration may increase manufacturing costs.

Two main parameters define the sizes of the input and output cavities: (1) the distance from the center to center of the cathodes, e.g. approximately 46 mm, and (2) the distance center to center of the clusters, e.g. 206.5 mm. These measurements set the radius of a circle on which guns are placed equal to 146 mm. In turn these sizes are defined by overall parameters of the gun (loading of the cathode, intensity of an electric field). Increase in size to more than 146 mm leads to a decrease of the distance of the neighboring parasitic mode to the operating frequency.

It may be beneficial to form each of the cavities with slightly differing outlines. An exemplary implementation of this is illustrated in the cavities shown in FIGS. 1 and 2. For example, the penultimate cavity PC#2 may have increased radii of rounding.

An MBK may further include a beam collector capable of operating with a beam having a peak power of up to 3 MW and an average power of up to 75 kW. The volume of a collector should support parasitic oscillations, as well as to reflect by a space charge electric field of the beam a part of delayed electrons. Therefore the collector for this tube may be divided into four electrically independent parts in order to reduce space charge effects. Simultaneously, while maintaining acceptable thermal loading on the collectors, this enables a reduction in their length. Further reduction in collector size can result from use of 24 independent micro-collectors, one for each beam-let.

A reduction of a voltage of the fourth cavity by it detuning on 100 MHz concerning operating frequency results in reduction of energy spread in a beam and to disappearance of reflections. However, the efficiency decreases from 66.6% to 65.3%.

The impact of a beam on a cone of an output is not dramatic. It is a natural process in a cooled collector. Here the density of Power can be rather insignificant.

Figure 5:
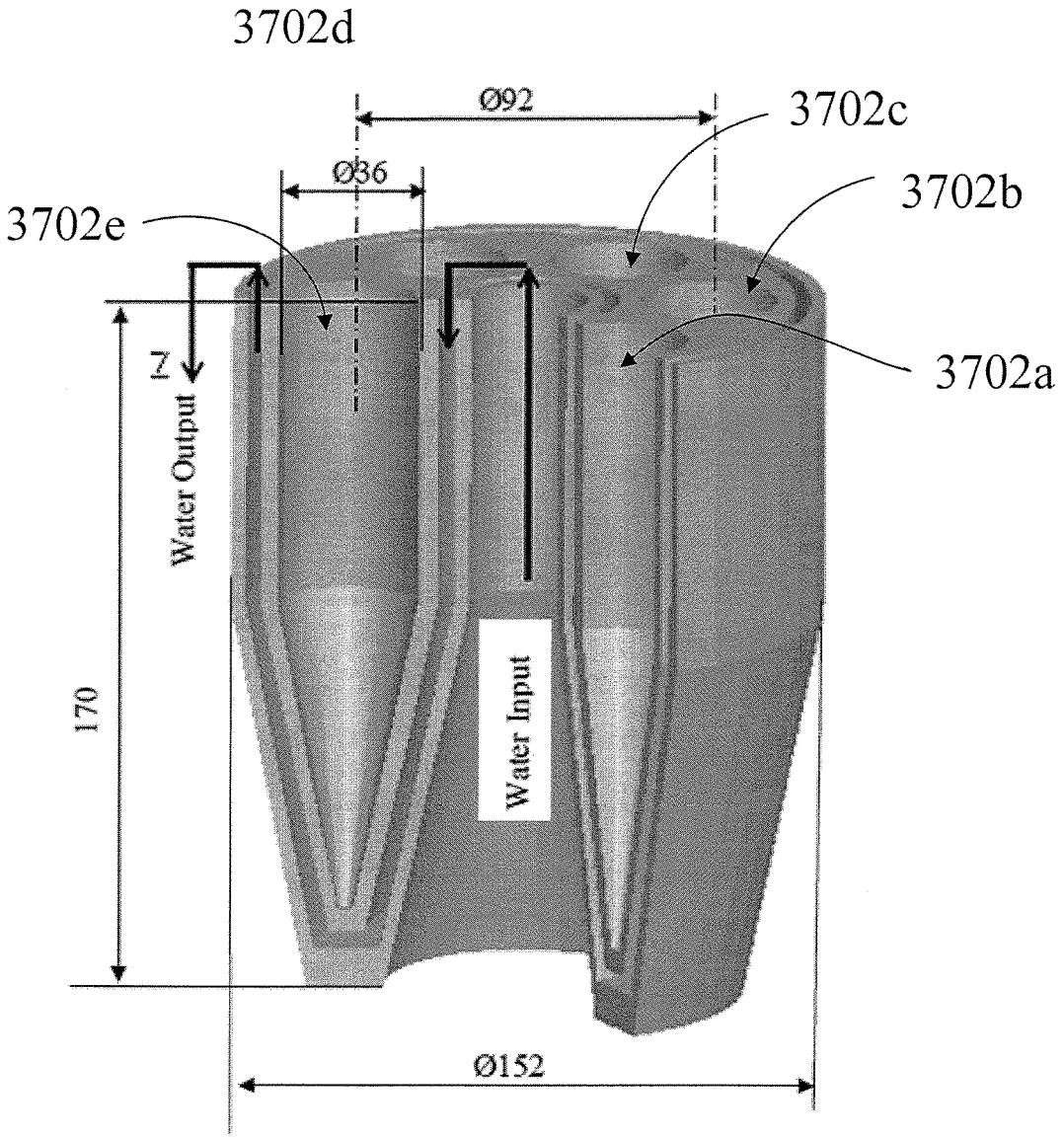
FIG. 5 illustrates aspects of an example beam collector.

FIG. 5 illustrates an exemplary collector having six holes. As illustrated in FIG. 5, the collector geometry includes an individual channel for each beamlet of a corresponding electron gun. For most accelerators, major contributions to electrical inefficiency originate with the magnets and the RF systems. Consequently, power supplies and high-power RF sources are logical targets for efficiency improvements.

Although examples have been provided of MBKs, aspects presented herein are applicable to a single-beam klystron, as well. One example of a single-beam klystron is the SLAC 5045 as deployed at LCLS, as detailed in A. Jensen, A. S. Beebe, M. Fazio, A. Haase, E. Jongewaard, C. Pearson, D. Sprehn, A. Vlieks, and L. Whicker, "25 Year Performance Review Of The SLAC 5045 S-Band Klystron", Proceedings of IPAC2011, MOPC142, San Sebastián, Spain (2011); and F.-J. Decker, A. Krasnykh, B. Morris, and M. Nguyen, "A Stability of LCLS Linac Modulators", SLAC-PUB-15083, 2012 IEEE International Power Modulator and High Voltage Conference, San Diego, Calif. (2012), the entire contents of both of which are incorporated herein by reference.

The relatively low operating voltage (60 kV) of the MBK allows reductions in cost and complexity for the modulator and associated components, but also introduces a challenge in collector design, because of the low energy of electrons in the spent beam. For the MBK with efficiency of about 65%, the mean electron energy after the output cavity is about 21 keV so that, with a current of 12 A per beam-let, space charge forces that could cause particle reflections towards the RF circuit can be an issue that might not be so severe with a higher voltage tube. Further, secondary electrons generated by the primary beam must also be prevented from leaving the collector, where they could impede device performance. As presented herein, space charge can actually serve to prevent secondary electrons born at the far end of the collector from streaming into the RF circuit.

Techniques to optimize collector energy recovery may include any combination of shaping applied electric and magnetic fields within the collector to guide electrons so as to smooth out heat deposition; employing asymmetry in the collector geometry to prevent back-streaming of reflected primary and secondary electrons; applying transverse magnetic fields to reduce back-streaming; and using materials of low secondary emission coefficient. Additionally, a location of the retarding field gap, together with a strongly non-uniform magnetic field having a significant transverse component near the gap, can be key features towards achieving significant energy recovery.

Depressed Collector

A depressed collector is a component employed to recover un-expended power from the spent electron beam after it emerges from the output cavity in a high power microwave tube. Hence, where efficiency and cooling issues are important, the performance of the depressed collector can be critical. This is relevant for a wide range of power tubes, including traveling-wave tube amplifiers in satellites, inductive output tubes in television transmitters, and klystrons employed in large-scale accelerator complexes.

Figure 6:
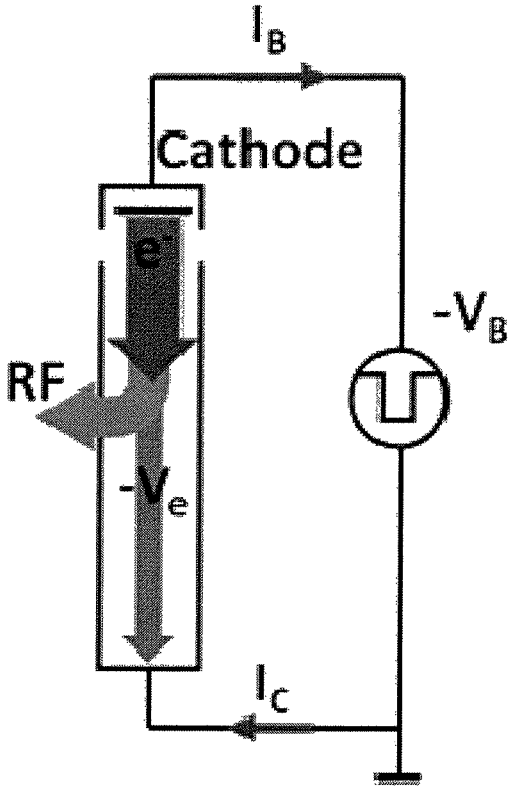
FIG. 6 illustrates a schematic of a microwave tube without a depressed collector.
Figure 7:
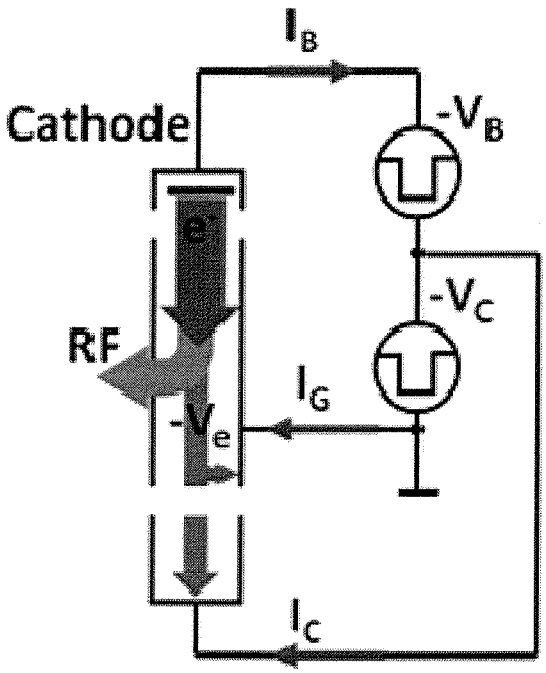
FIG. 7 illustrates a schematic of a microwave tube with a single-stage depressed collector.
Figure 8:
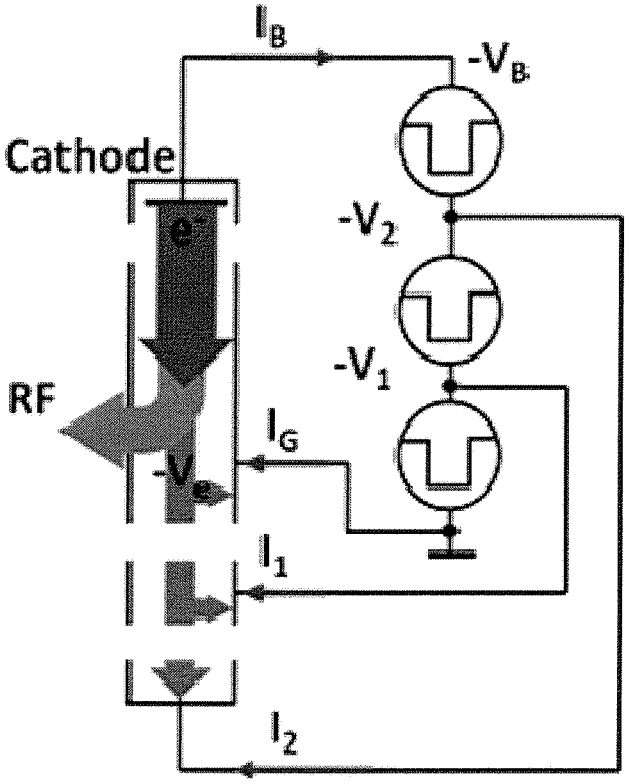
FIG. 8 illustrates a schematic of a microwave tube with a multi-stage depressed collector.
Figure 9:
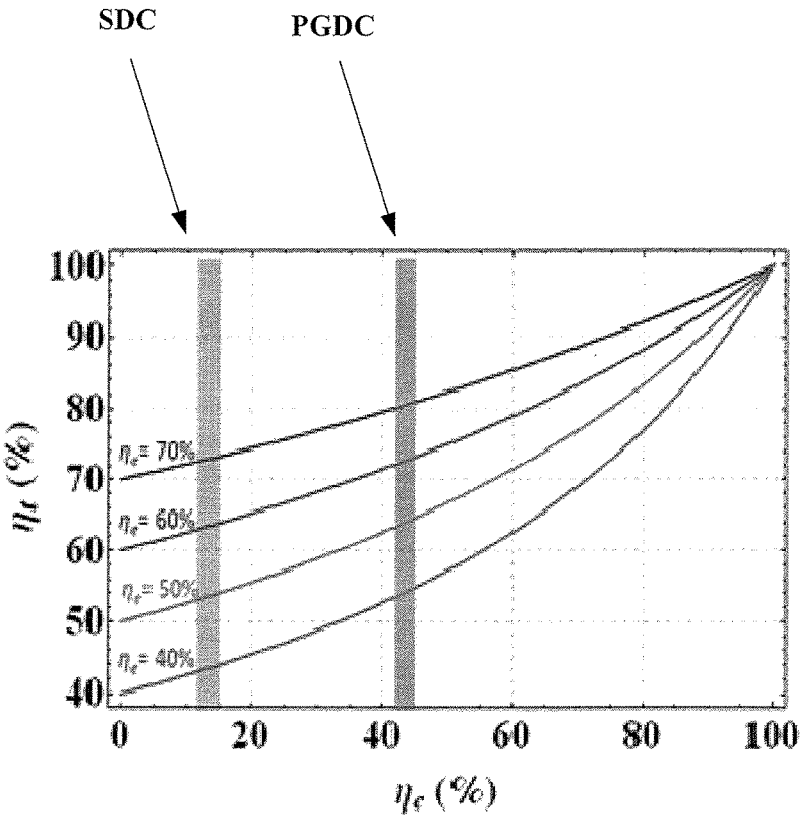
FIG. 9 illustrates a graph showing efficiency of overall efficiency versus collector efficiency.

FIGS. 6-9 illustrate example schematics of microwave tubes without DC in FIG. 6, with single stage DC (SDC) in FIG. 7, and with multi-stage DC (MSDC) in FIG. 8. FIG. 9 shows overall MBK efficiency $\eta_t$ vs collector efficiency $\eta_c$ for four values of RF circuit efficiency $\eta_e$, where the red bar indicates $\eta_c$ for a conventional SDC, and blue for the PGDC presented herein.

For a microwave tube without a DC, as shown schematically in FIG. 6, initial electrons with beam voltage $V_B$ and beam current $I_B$ are emitted from the cathode at a voltage $-V_B$, convert some beam energy into microwaves in the RF circuit, and drop the beam voltage to an effective spent beam voltage $V_e$ before entering the collector. The output RF power is $I_B(V_B-V_e)$. For a DC operated at a voltage $-V_C$ and collecting the fractional current $I_C$, tube efficiency is $$\eta_t = \frac{I_B(V_B - V_e)}{I_B V_B - I_C V_C} = \frac{\eta_e}{1 - I_C V_C / I_B V_B} = \frac{\eta_e}{1 - \eta_c(1 - \eta_e)} \tag{1}$$

where the RF circuit efficiency $\eta_e$ without the DC is defined as $\eta_e=1-V_e/V_B$; the collector efficiency $\eta_c$ is defined as $\eta_c=I_C V_C/I_B V_e$ in a SDC and as $\eta_c=\Sigma I_{S_n} V_{S_n}/I_B V_e$ for a MSDC, with each stage voltage $V_{S_n}$ and collected current $I_{S_n}$, as shown in FIGS. 7 and 8. The denominator $1-\eta_c(1-\eta_e)$ can be interpreted as being proportional the effective external power after energy recovery with an efficiency $\eta_c$ from the un-expended beam $(1-\eta_e)$. In the Omega-P MBK, $\eta_e$=65% with a beam voltage $V_B$=60 kV, so the effective spent beam voltage is $V_e=(1-\eta_e)V_B$=21 kV.

FIG. 9 shows the overall efficiency $\eta_t$ to be a monotonically-increasing function of the collector efficiency $\eta_c$ for a given RF circuit efficiency $\eta_e$. Hence to improve the overall efficiency, one must increase the collector efficiency $\eta_c$. The design methodology for a conventional DC is to require the voltage of the depressed electrode $V_C$ in the SDC (or the first stage voltage in MSDC) to be at the minimum beam voltage $V_m$ of the spent beam. This is to prevent low energy electrons from being reflected back into the upstream RF circuit. As a result, the depressed circuit loop current $I_G$ is zero. If we were to apply this approach to our MBK, the depressed collector voltage would be $V_C$=3 kV. The collected beam current is $I_C$=12 A for each channel (ignoring beam loss), and the effective spent beam voltage is $V_e$=21 kV. This leads to a collector efficiency $\eta_c=I_C V_C/I_B V_e$=14.3%. For our RF circuit efficiency $\eta_e$=65%, the net efficiency would be rt=68%: only a marginal improvement.

In order to improve collector efficiency, presented herein is a depressed collector comprising a grounded portion that collects electrons that would ordinarily be reflected. Such a collector is also referred to interchangeably as a Partly Grounded Depressed Collector (PGDC). The PGDC may also comprise a biased portion that collects electrons with depressed energies.

In this way, the recovered power $I_C V_C$ in the collector can be greatly increased with only negligible reflected current. But now the depressed circuit loop current $I_G$ is non-zero, depending on the collector voltage $V_C$; this current must be provided by the depressed power supply. Thus the target function to be optimized is the recovered power $I_C(V_C)\cdot V_C$ for the spent beam distribution entering the PGDC. For modeling purposes, we define the spent beam current distribution $J(V; V_0)$ as a function of beam voltage V, where $V_0$ is a scaling constant that is determined by solving for the total spent beam power $P=I_B V_B(1-\eta_e)$ which can also be written as $P_S(V_0)=\int_0^\infty J(V; V_0)\cdot V dV$ For example, for a uniform distribution, we have JV=IB/V0 between a minimum $V_{min}$ and maximum $V_{max}$. Thus $V_0=2(V_e-V_{min})$, which yields $V_0$=36 kV for an MBK with $V_e$=21 kV and $V_{min}$=3 kV. Ideally, the portion of spent beam with voltage V greater than the collector voltage $V_C$ can penetrate into the depressed collector, deposit energy there, and constitute the depressed collector current $I_C$ which can be written $I_C=\int_{V_C}^\infty J(V)dV=I_B(1-x_c+x_{min})$, where the normalized voltage is $x=V/V_0$. So the collector efficiency $\eta_c$ becomes $\eta_c=2x_c(1-x_c+x_{min})/(1+^2x_{min})$. This function has a maximum of 0.50 at $x_c=(1+x_{min})/2\approx 0.54$. Thus the optimal overall efficiency is $$\eta_t = \frac{\eta_e}{1-0.50(1-\eta_e)} \tag{2}$$

with $\eta_c$=50%, $I_C$=00.542$I_B$, $I_G$=00.458$I_B$, and $V_C$=0.93$V_e$. For our 2.5 MW L-band MBK at $\eta_e$=65%, the theoretical upper limit for the overall efficiency in PGDC is, according to this model, $\eta_t$=79%. For spent beam distributions other than the uniform distribution, where a large energy spread is expected, one can work out similar upper-limit efficiencies: for example, $\eta_h$=76.2% for the Gamma distribution $J(V)=V/V_0 e^{-V/V_0}$; and rt=75% for the Maxwell distribution $J(V)=2I_B\sqrt{V/V_0}\pi e^{-V/V_0}$. To further demonstrate the appealing features of PGDC, the overall efficiency of a conventional MSDC (i.e., one with zero depressed circuit loop currents) is estimated for comparison with PGDC, as shown in FIGS. 11-12.

Figure 10:
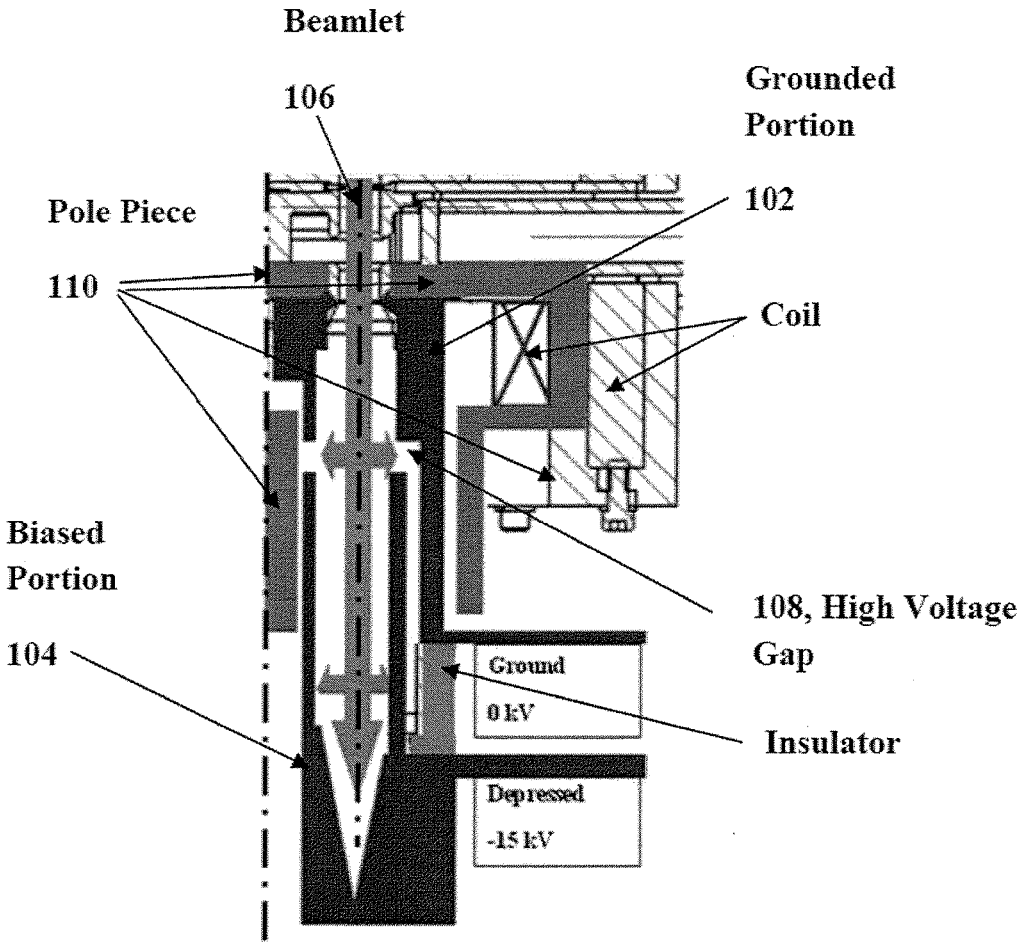
FIG. 10 illustrates aspects of a partially-grounded depressed collector.

FIG. 10 illustrates an example layout of a PGDC incorporated into an example MBK. As illustrated in FIG. 10, the PGDC may include a grounded portion 102 configured to collect a portion of electrons entering the collector and a biased portion 104 configured to collect another portion of the electrons entering the collector. The biased portion may collect the electrons having a depressed energy. A spent beam 106 from the RF source to which the beam collector is coupled enters the beam collector. The grounded portion may be positioned closest to the output of the RF source and the biased portion may be positioned to receive the spent beam after it passes the grounded portion. The PGDC is also illustrated having high voltage gap 108 and pole piece 110.

Figure 11:
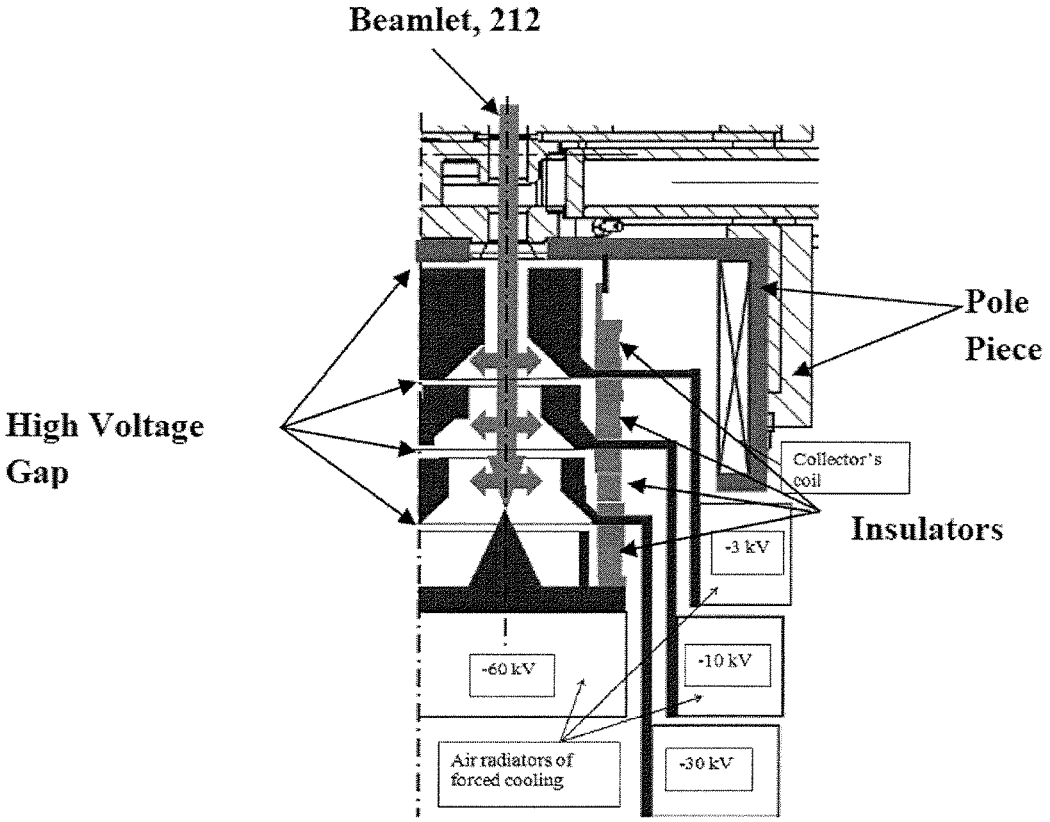
FIG. 11 illustrates aspects of a multi-stage depressed collector.
Figure 12:
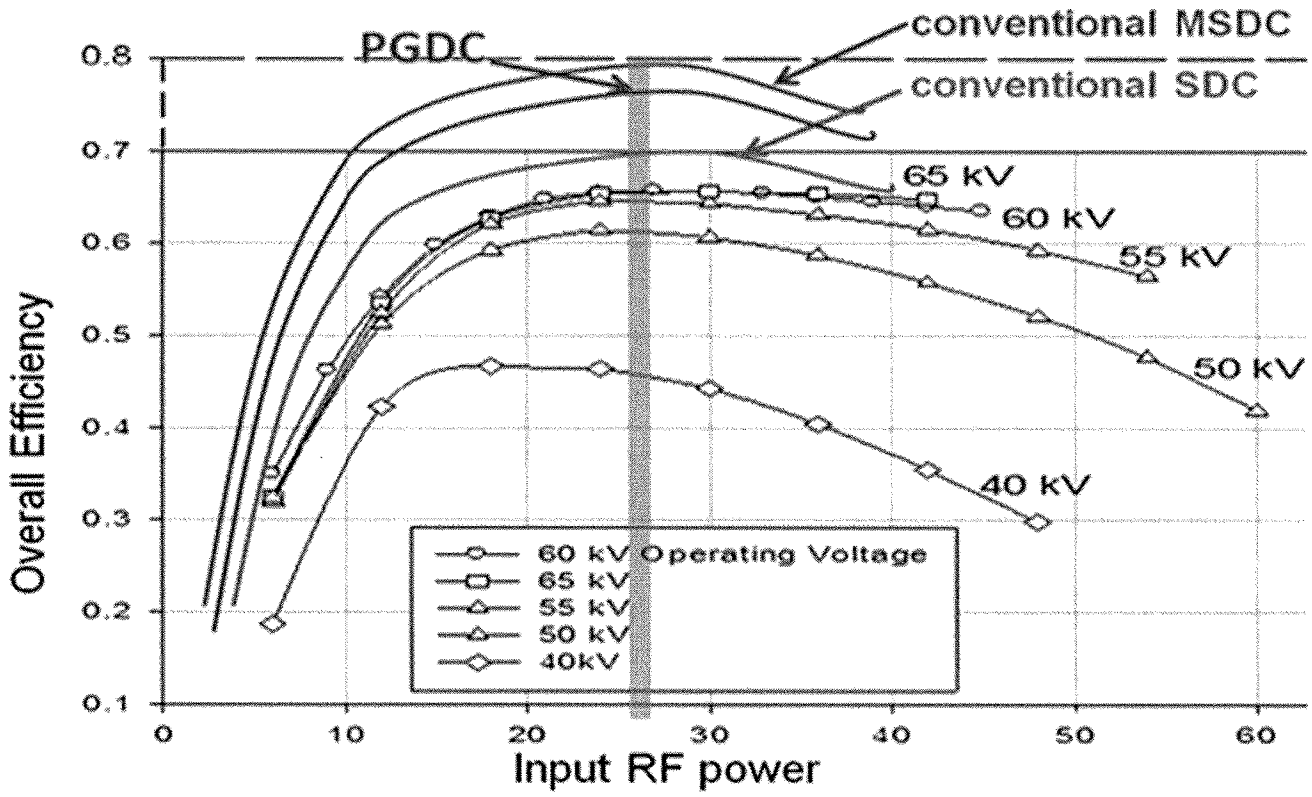
FIG. 12 is a graph of a comparison of efficiency of a single stage depressed collector to a multi-stage beam collector and a partially-grounded depressed beam collector.

FIG. 11 illustrates an MSDC receiving spent beam 212 and having multiple biased portions, each biased with a different voltage. FIG. 12 illustrates a comparison of the MSDC and the PGDC.

While FIG. 11 is illustrated without a grounded portion, aspects presented herein may also be used in a multi-stage depressed collector. For example, the MSDC of FIG. 11 may be configured to include a grounded portion as the initial portion of the beam collector into which the spent beam enters.

The MSDC is modeled as a 4-stage depressed collector with voltages −3 kV, −10 kV, −30 kV and −60 kV for each stage. The maximum efficiency is 80%, significantly higher than the conventional SDC, but only marginally higher than the PGDC we propose here, and with a much more complicated and costly collector design and need for four collector power supplies.

If the spent beam has a large energy spread, MSDC with non-zero depressed circuit loop currents may be appealing, as it can sort segments of spent beam energy into successive collector channels to increase the overall efficiency. Ideally, the portion of spent beam with beam voltage V greater than the $m^{th}$ stage collector voltage $V_m$ but less than the next stage voltage $V_{m+1}$ will deposit energy into the $m^{th}$ stage, with a current $I_m=\int_{V_m}^{V_{m+1}} J(V)dV$; the recovered power at that stage is $P_m=V_m I_m$. So with a final stage voltage $V_n$ and total number of stages n, optimizing the total recovered power without constraining the depressed circuit loop current to be zero, the MSDC collector efficiency $\eta_c$ and total tube efficiency $\eta_t$ can be determined, as shown in FIGS. 13A and 13B. One sees that, for a four-stage MSDC, the optimal tube efficiency can be up to 87.4%, as compared to 80% for the conventional MSDC mentioned above.

The graph in FIG. 13A shows MSDC total tube efficiency $\eta_t$ (solid lines) and collector efficiency $\eta_c$ (dotted lines) vs the last stage voltage $V_n$, with single stage (purple), two stages (blue), three stages (green), four stages (red), and higher stages (brown), where the RF circuit efficiency without depressed collector $\eta_e$ is 65% and the spent beam is taken to have a Gamma distribution $J(V)=I_B V_e^{-V/V_0}/V_0$. The table in FIG. 13B lists specific aspects in connection with FIG. 13A.

For example, a single stage PGDC having aspects presented herein, e.g., for an 2.5 MW MBK, provide net efficiency enhanced to 76-79%, from 65% without DC, as is predicted by the above theory for beam energy distributions ranging from Gamma to uniform.

Figure 14:
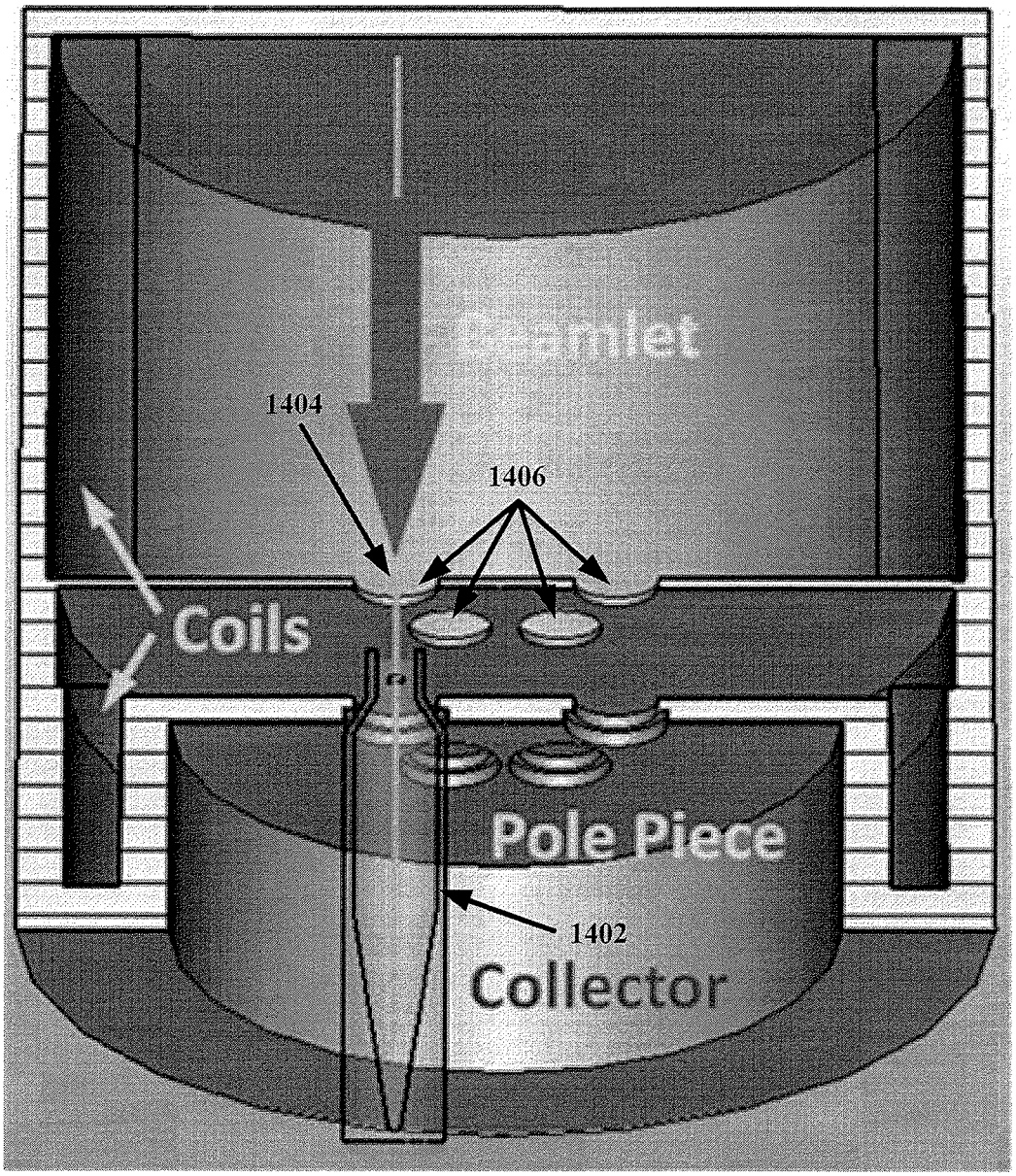
FIG. 14 illustrates an example beam collector.
Figure 15:
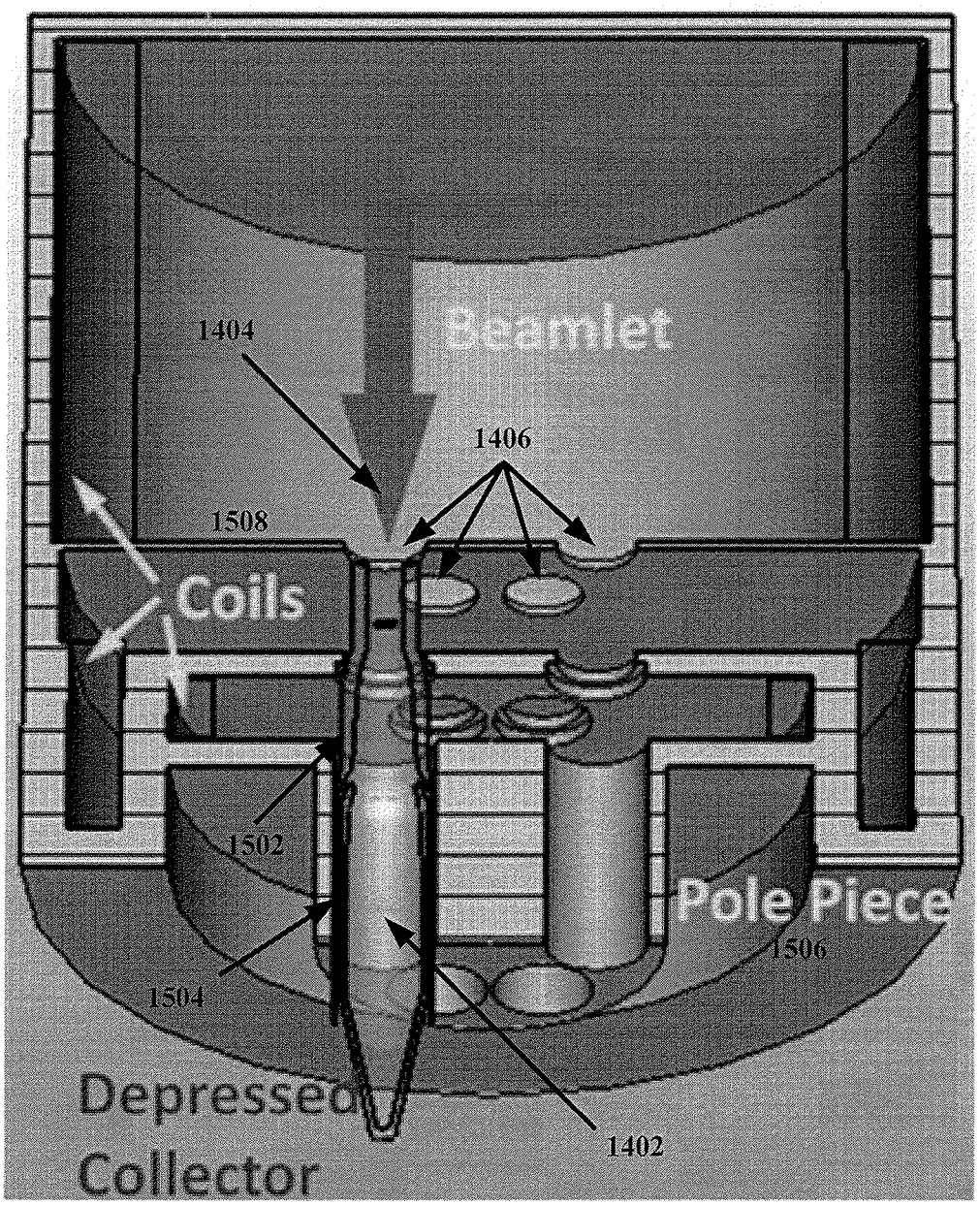
FIG. 15 illustrates an example partially grounded depressed beam collector.
Figure 16:
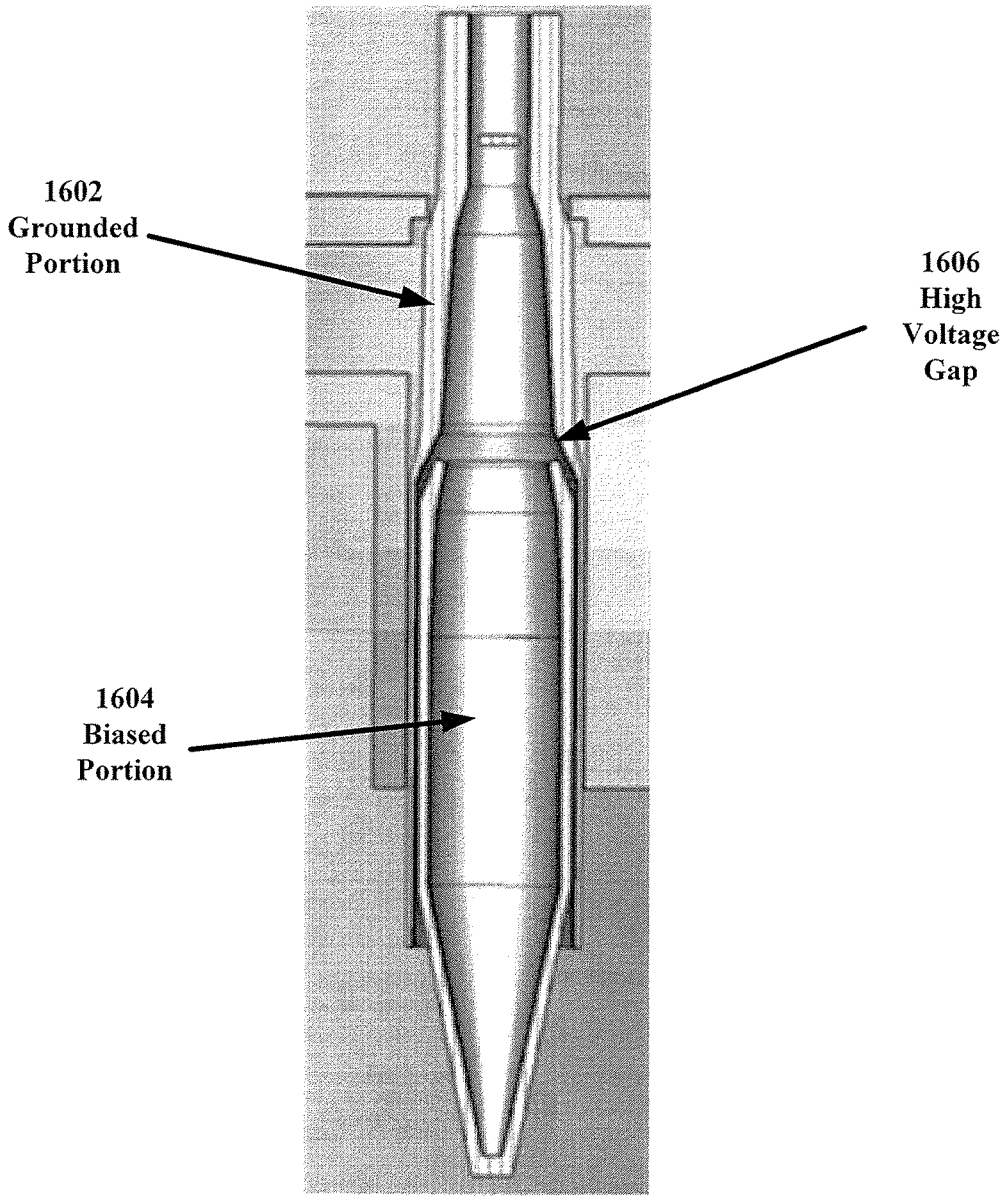
FIG. 16 illustrates an example partially grounded depressed beam collector.

Aspects of an example beam collector are illustrated in FIGS. 15 and 16. FIG. 14 illustrates a cross section of a collector without a grounded portion. FIG. 15 illustrates a cross section of a PGDC having an additional magnetic lens system added with a collector coil and iron pole piece. In FIGS. 14 and 15, only a single beam collector opening 1402 is illustrated and its correspondence to a single electron beam 1404 is shown. Both FIGS. 14 and 15 illustrate that there may be openings 1406 corresponding to a plurality of electron beams from an electron gun. A collector opening 1402 may be formed to correspond to each of the beamlet openings. As illustrated in FIGS. 3A, 3B, and 5, the beam collector may comprise multiple channels, each channel corresponding to a single electron beam.

Details of a PGDC, as in FIG. 15 are illustrated in connection with FIGS. 10 and 16.

A PGDC may further include a high voltage gap, e.g., 108 in FIGS. 10 and 1606 in FIG. 16, and an iron pole piece 1506 at least partially surrounding the high voltage gap. The collector in FIG. 15 includes a grounded portion 1502 and a biased portion 1504. The iron pole piece may be formed with channels to surround the channels of a multi-channel beam collector.

As illustrated, a PGDC may include a magnetic lens system configured to suppress reflection of a spent beam. Among other aspects, this may include a collector coil 1508 and/or the iron pole piece 1506. The magnetic lens may configured to create a magnetic field for guiding a spent beam to penetrate the grounded portion and then to disperse. The magnetic field may be configured to disperse the spent beam near and beyond a high voltage gap.

Figure 17:
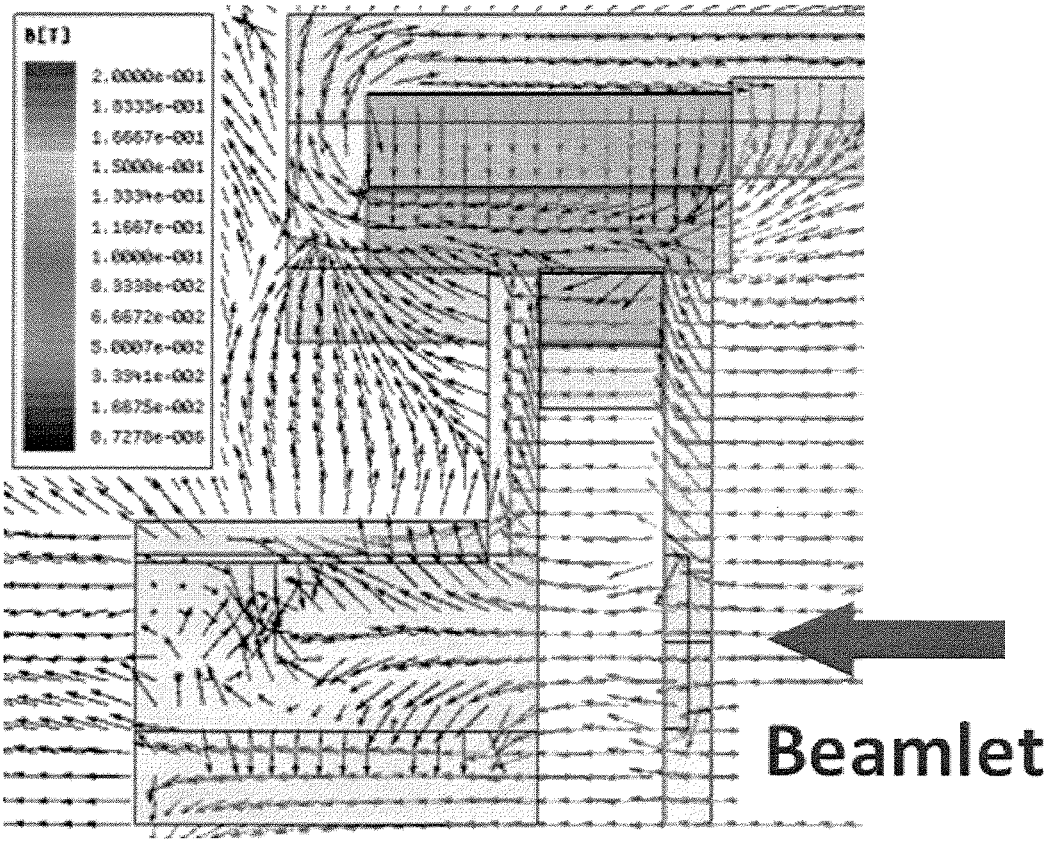
FIG. 17 is a magnetic field distribution within a partially grounded depressed collector.
Figure 18:
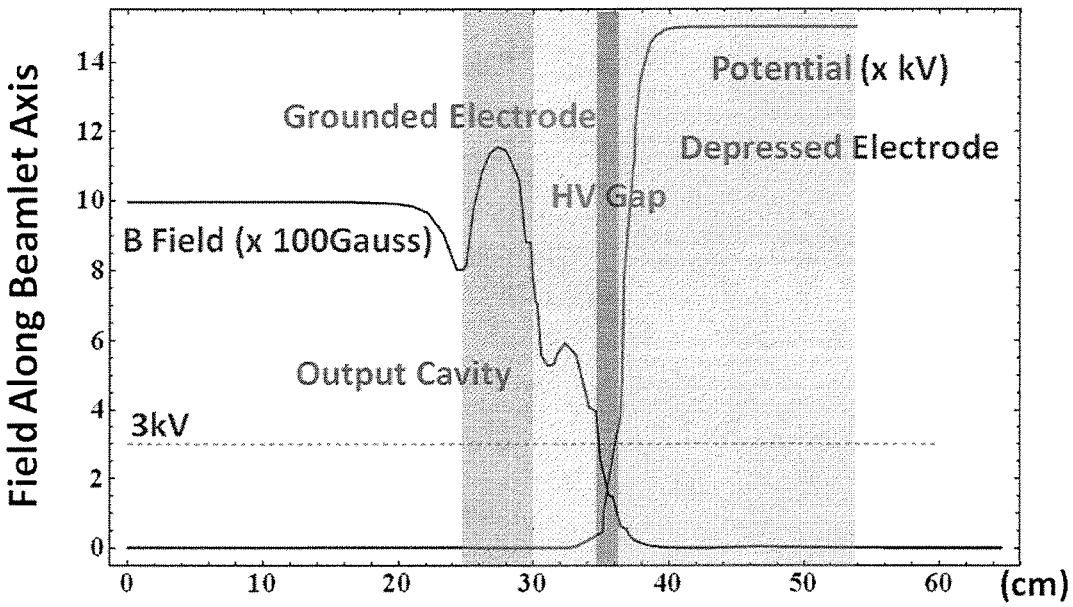
FIG. 18 illustrates static potential and magnetic field distribution for an example partially grounded depressed beam collector.

FIG. 16 illustrates an example collector, such as in FIG. 15, including a grounded portion 1602, a biased portion 1604, and a high voltage gap 1606. The insulator is not shown. FIG. 17 illustrates a magnetic field distribution within a depressed collector, as in FIG. 15. FIG. 18 illustrates static potential and magnetic field distributions along the beam-let axis.

The collector, shown in FIG. 15, is divided into two parts, one grounded and the other attached to the depressed power supply at voltage $V_C$. The design, similar to that illustrated in FIG. 5 may include a distinct channel for each beam-let. A magnetic lens system may be added to suppress the reflected beam, as shown in FIG. 15. This magnetic field is to guide the spent beam to penetrate through the grounded section and then disperse near and beyond the high voltage gap where the magnetic field magnitude drops rapidly with a significant transverse component due to a pole piece around the gap. In this region, space charge forces may disperse the trajectory of decelerated spent beam and break the adiabatic condition which otherwise would allow electrons to be reflected back to the upstream RF circuit. Hence aspects of the PGDC presented herein include an ultra-compact single stage depressed collector, but with an efficiency approaching, or even exceeding, that of a conventional multi-stage depressed collector.

While the illustrated example is for an MBK, this concept can be applied to other RF sources such as high power microwave tubes, including single-beam klystrons, IOT's, and TWTs, among others; in order to boost efficiency and reduce device dimensions. The PGDC presented herein avoids the complexity with multiple power supplies and HV insulators.

Space Charge

Figure 19A:
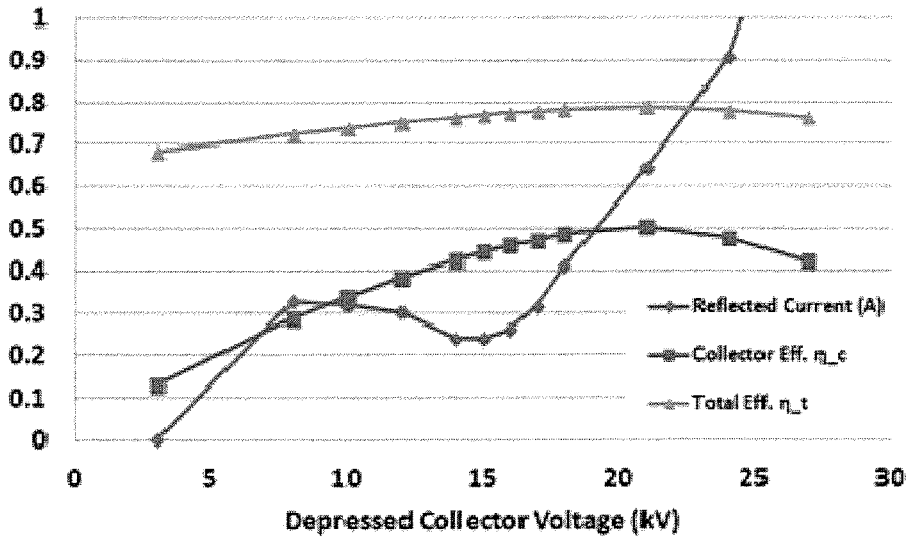
FIG. 19A is a graph showing partially grounded depressed beam collector performance without space charge.
Figure 19B:
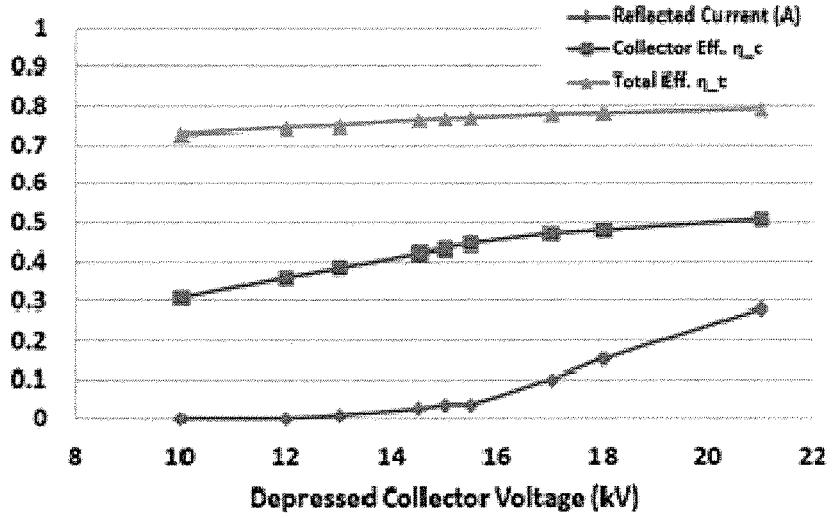
FIG. 19B is a graph showing partially grounded depressed beam collector performance with space charge.

Due to the presence of the iron pole piece near the gap, space charge effects disperse low energy electrons towards the collector electrode, and hence prevent reflected electrons from following the magnetic field adiabatically and moving back towards the RF circuit. PGDC performance vs depressed collector voltage, with or without space charge, is shown in FIGS. 19A and 19B. FIG. 19A illustrates PGDC performance without space charge, and FIG. 19B illustrates PGDC performance with space charge. The bottom curve in each picture is the reflected current, the middle curve is the collector efficiency, and the green curve is total tube efficiency.

A maximum tube efficiency of 79% and collector efficiency of 50% are as predicted by Eq. (2) for a uniform distribution without space charge. But there is seen a fairly large reflected current at higher depressed collector voltages. However, when turning on the space charge, e.g., in a simulation, reflected current drops dramatically, as seen in FIG. 19B, which illustrates the benefits from space charge for PGDC. As a conservative compromise between efficiency and reflected current, a depressed collector voltage of 15 kV may be chosen, giving a collector efficiency of 43% and total tube efficiency 77%, as shown in FIG. 19B; the current to the depressed collector portion is 7.3 A, with 4.7 A to the grounded collector portion.

Figure 20A:
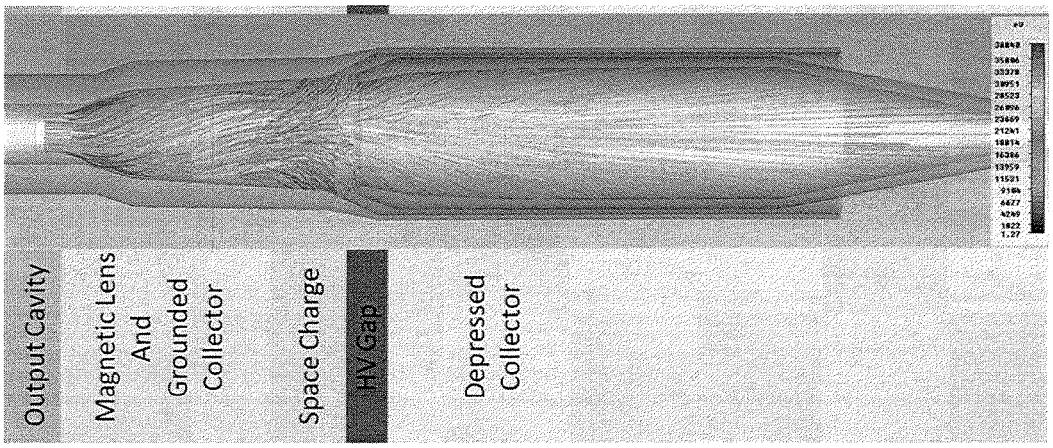
FIG. 20A illustrates spent beam trajectories in an example partially grounded depressed beam collector.
Figure 20B:
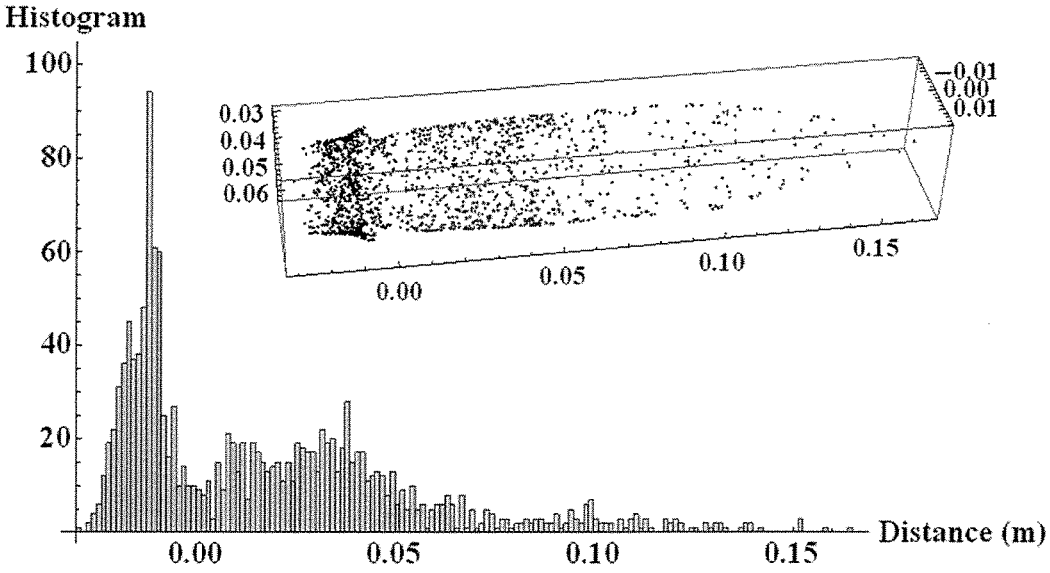
FIG. 20B is a histogram of electron final positions on a partially grounded depressed collector inner surface.

Spent beam trajectories are shown in FIG. 20A, including space-charge. FIG. 20B shows a histogram of electron final positions on the collector inner surface. FIG. 20A illustrates spent beam trajectories in the PGDC with depressed collector voltage at −15 kV and having space charge included in the simulation, with each interaction region colored. FIG. 20B illustrates a histogram of electron final positions on collector inner surface, with blue dots for grounded electrodes, red for depressed electrode.

Secondary Electron Emission

Figure 22A:
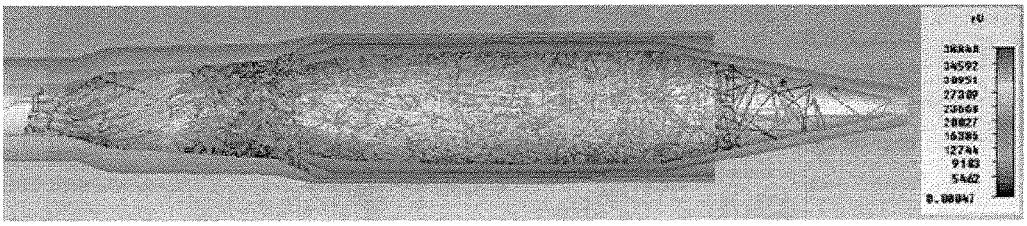
FIG. 22A illustrates spent beam trajectories of primary and secondary electrons in an example partially grounded depressed beam collector.
Figure 22B:
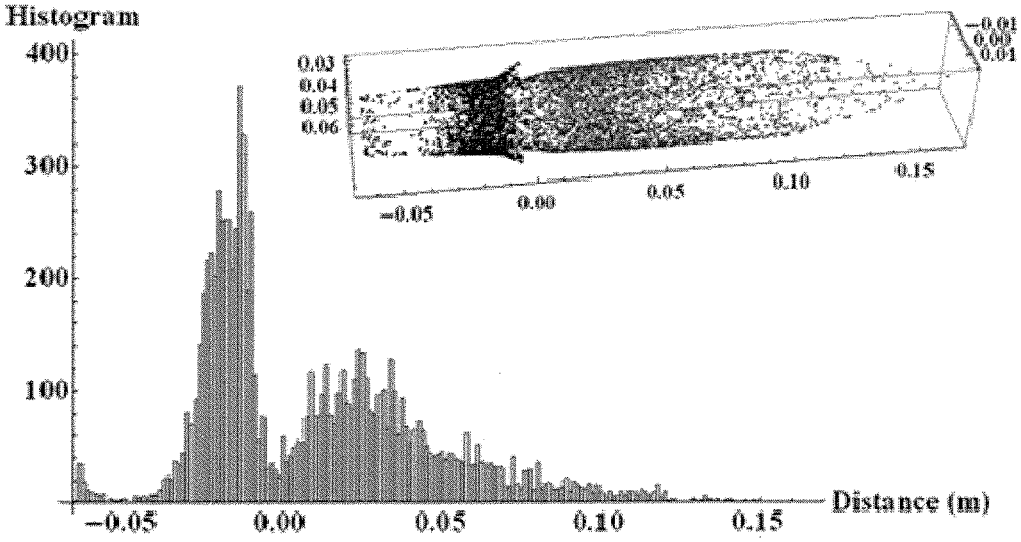
FIG. 22B is a histogram of electron final positions on a partially grounded depressed collector inner surface.

Secondary emission from the depressed electrode could adversely degrade performance of the collector, unless the secondary electrons are recaptured by the depressed electrode again without escaping the grounded electrode. Preliminary results for aspects presented herein show, with a depressed potential of −15 kV, that the depressed collector current drops to 6.2 A, with a collector efficiency of 37% and a total efficiency of 75%, as illustrated in FIGS. 22A and 22B when the secondary emission model is enabled in the simulation. FIG. 22A illustrates trajectories of the primary and secondary electrons. FIG. 22B illustrates a histogram of the electron final positions on the collector inner surface.

In order to suppress such secondary emission, the depressed collector can be made, e.g., of material with low secondary emission coefficient or coated with such a material. Additionally, the depressed collector can be prepared with a proper surface treatment. Further optimization of collector material and geometry may be used to improve recapture rate.

Un-Modulated Beam

Figure 21:
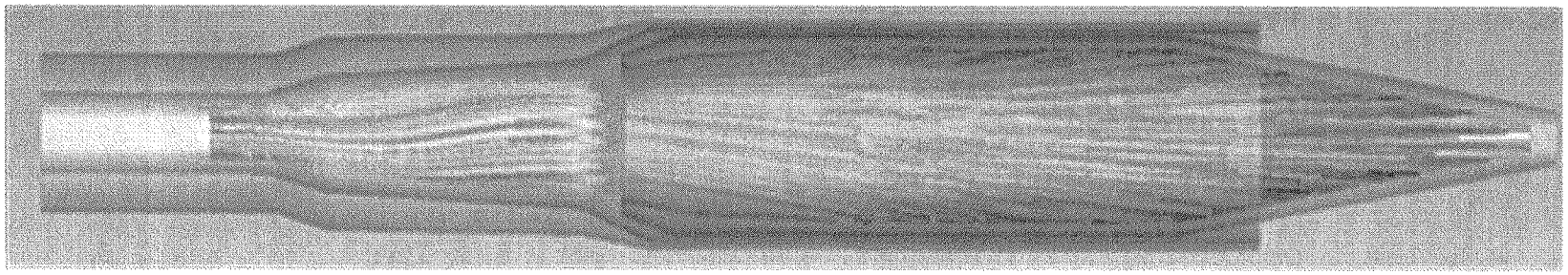
FIG. 21 illustrates electron trajectories for an un-modulated beam in a partially grounded depressed beam collector.

FIG. 21 illustrates electron trajectories of un-modulated beam in PGDC with −15 kV on depressed collector. In case of no RF drive, the un-modulated 60 kV beam has been modeled as a uniform distribution with energy spread of 10%. This high power beam is seen in FIG. 21 to be well contained in the depressed collector region with fairly uniform power loading on the collector surface.

Aspects of a high-power single-stage Partially-Grounded Depressed Collector PGDC in one example, for use with RF sources, such as a 2.5 MW L-band MBK have been described. PGDC obtains high energy recovery-comparable to that of a four-stage conventional depressed collector-through use of a grounded collector portion that absorbs reflected low-energy electrons, thus preventing their return to the MBK cavities or cathode. Further, a steep gradient in applied magnetic field near the voltage gap before the depressed collector may be employed to impart transverse deflection to beam electrons, and space charge forces provide trapping of secondary electrons against leaving the collector.

For a beam that upon exit from the output cavity has a prescribed energy distribution, predict an increase in the 65% intrinsic MBK efficiency up to between 75% and 79%, depending upon the energy distribution of the exiting beam. The layout, as illustrated in FIG. 15 for a single-stage depressed collector is relatively simple.

However, additional stages may also be used and results in even greater efficiency enhancement: 4 stages could yield an 87% net tube efficiency. The principles invoked in this project for a 60-kV, 12 A per beam-let, 6 beam-let MBK are also applicable for other high-power linear beam tubes, such as conventional klystrons, IOT's, and travelling-wave tubes. The net result of achieving successful results in this project in the design for future MBK's for ILC, or for other accelerator systems employing large numbers of high-power linear beam tubes, should be a significant reduction in wall-plug power demand, together with a dramatic reduction in cooling demands for the waste heat.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

While this invention has been described in conjunction with the example implementations outlined above, various alternatives, modifications, variations, improvements, and/or substantial equivalents, whether known or that are or may be presently unforeseen, may become apparent to those having at least ordinary skill in the art. Accordingly, the example implementations of the invention, as set forth above, are intended to be illustrative, not limiting. Various changes may be made without departing from the spirit and scope of the invention. Therefore, the invention is intended to embrace all known or later-developed alternatives, modifications, variations, improvements, and/or substantial equivalents.

What is claimed is:

1. A depressed beam collector comprising:

a grounded portion configured to collect a portion of electrons entering the collector;

a biased portion configured to collect another portion of the electrons entering the collector and having a depressed energy, wherein the grounded portion and the biased portion each form a portion of a wall of the depressed beam collector;

a high voltage gap comprising a spacing in the wall between the grounded portion and the biased portion; and a magnetic lens at least partially surrounding the high voltage gap.

2. The depressed beam collector of claim 1, wherein the beam collector comprises a plurality of channels, each channel corresponding to one of a plurality of electron beams.

3. The depressed beam collector of claim 1, wherein the biased portion is coupled to a depressed power supply at a collector voltage.

4. The depressed beam collector of claim 1, wherein the magnetic lens is configured to suppress reflection of a spent beam functioning in concert with the space charge distribution.

5. The depressed beam collector of claim 4, wherein the magnetic lens is configured to create a magnetic field for guiding a spent beam to penetrate the grounded portion and then to disperse.

6. The depressed beam collector of claim 5, wherein the magnetic field is configured to disperse the spent beam near and beyond a high voltage gap.

7. The depressed beam collector of claim 1, wherein the magnetic lens comprises an iron pole piece at least partially surrounding the high voltage gap.

8. The depressed beam collector of claim 1, wherein the depressed beam collector comprises space charge forces configured to disperse a trajectory of a decelerated spent beam.

9. The depressed beam collector of claim 1, wherein the beam collector is a single-stage depressed beam collector.

10. The depressed beam collector of claim 1, wherein the beam collector is a multi-stage depressed beam collector.

11. The depressed beam collector of claim 1, further comprising cooling channels comprised in the grounded portion and the biased portion.

12. The depressed beam collector of claim 1, wherein the depressed beam collector comprises a material having a low secondary emission coefficient.

13. The depressed beam collector of claim 1, further comprising:

a coating of a material having a low secondary emission coefficient.

14. An RF source comprising:

an electron gun; and a depressed beam collector including:

a grounded portion configured to collect a portion of electrons entering the collector;

a biased portion configured to collect another portion of the electrons entering the collector and having a depressed energy, wherein the grounded portion and the biased portion each form a portion of a wall of the depressed beam collector;

a high voltage gap comprising a spacing in the wall between the grounded portion and the biased portion; and a magnetic lens at least partially surrounding the high voltage gap.

15. The RF source of claim 14, wherein the electron gun is configured to emit a plurality of electron beams, and wherein the beam collector comprises a plurality of channels, each channel corresponding to one of the plurality of electron beams.

16. The RF source of claim 14, wherein the biased portion is coupled to a depressed power supply at a collector voltage.

17. The RF source of claim 14, wherein the magnetic lens is configured to suppress reflection of a spent beam.

18. The RF source of claim 14, wherein the magnetic lens comprises an iron pole piece at least partially surrounding the high voltage gap.

19. An RF source comprising:

a multi-beam klystron; and a depressed beam collector including:

a grounded portion configured to collect a portion of electrons entering the collector;

a biased portion configured to collect another portion of the electrons entering the collector and having a depressed energy, wherein the grounded portion and the biased portion each form a portion of a wall of the depressed beam collector;

a high voltage gap comprising a spacing in the wall between the grounded portion and the biased portion; and a magnetic lens at least partially surrounding the high voltage gap.

20. The RF source of claim 19, wherein the biased portion is coupled to a depressed power supply at a collector voltage.

* * * * *